United States Patent [19]

Sugino et al.

[11] Patent Number: 4,798,339

[45] Date of Patent: Jan. 17, 1989

[54] SUBMERGED JET INJECTION NOZZLE

[75] Inventors: Kenji Sugino, Uozu; Katsuya Yanaida, Shiga; Hiroshi Sugino, Nishinomiya; Masao Nakaya, Kurobe; Nobuo Nishida; Kensaku Eda, both of Toyama, all of Japan

[73] Assignee: Sugino Machine Limited, Toyama, Japan

[21] Appl. No.: 921,969

[22] Filed: Oct. 22, 1986

Related U.S. Application Data

[63] Continuation of Ser. No. 695,897, Jan. 29, 1985, abandoned.

[30] Foreign Application Priority Data

Feb. 13, 1984 [JP] Japan ..... 59-25681

[51] Int. Cl.[4] ..... B05B 1/02

[52] U.S. Cl. ..... 239/601; 175/424

[58] Field of Search ..... 239/589, 590, 593, 594, 239/599, 601, 602, 288, 288.5; 175/63, 65, 340, 422 R

[56] References Cited

U.S. PATENT DOCUMENTS

| | | | |
|---|---|---|---|
| 4,223,84 | 9/1980 | Schaller et al. | 239/601 |
| 1,940,171 | 12/1933 | Huss | 239/589 |
| 2,125,445 | 8/1938 | Holveck | 239/599 |
| 3,620,457 | 11/1971 | Pearson | 239/601 |
| 3,684,176 | 8/1972 | Hruby | 239/590 |
| 3,705,693 | 12/1972 | Franz | 239/602 |
| 4,432,497 | 2/1984 | Woste | 239/589 |
| 4,519,545 | 5/1985 | Kumizecz et al. | 239/288 |

*Primary Examiner*—Andres Kashnikow
*Assistant Examiner*—Kevin Patrick Weldon
*Attorney, Agent, or Firm*—Thomas H. Whaley

[57] ABSTRACT

A submerged jet injection nozzle includes a nozzle exit disposed downstream of an orifice section and greater in diameter than the orifice section. The occurrence of cavitation due to a fluid injection is positively promoted so that the crushing effect of the cavitation is utilized fully and the decay in the energy of the injected fluid is reduced thereby increasing the work done by the submerged fluid injection.

3 Claims, 2 Drawing Sheets

SUBMERGED JET INJECTION NOZZLE

This is a continuation of application Ser. No. 695,897 filed Jan. 29, 1985 now abandoned.

BACKGROUND OF THE INVENTION

1. Field of the Invention

The present invention relates to a high-pressure fluid injection nozzle and more particularly to the shape of such nozzle which ensures more effective action of a cavitation phenomenon by a high-pressure fluid jet under water or other fluid.

2. Description of the Prior Art

So-called high-pressure fluid jet processing techniques have been used in which a fluid under high pressure is injected through a small-diameter orifice and the high-pressure fluid is converted to a high-velocity fluid thereby utilizing the energy of the high-velocity fluid for various processing purposes. These high-pressure fluid jet processing techniques have been mainly used effectively for such purposes as cleaning, peeling, drilling and cutting. While the fluid jet has been mostly used in the air in these applications, the fluid jet has also been used in specific gaseous bodies. Also, as special cases, the fluid jet has been used in water or other fluids as disclosed for example in Japanese Patent No. 1117857 and Japanese Utility Model Registration No. 1436331.

While the high-pressure fluid jet processing techniques have been used in various applications as mentioned above, it has been considered that the energy of an injected high-pressure fluid is decayed by a surrounding fluid at a greater rate when used in a fluid such as water than when used in any gaseous body and how to decrease the rate of energy decay is an important point for enhancing the utilization effect.

Therefore, many different means have been adopted to decrease the decay as far as possible. For instance, attempts have been made such that the distance between the nozzle and an object is decreased, that it is devised so that the fluid supplied to the orifice of the nozzle becomes as nearly like a laminar flow as possible, that a space made of a gaseous body such as air is provided near an object in a fluid, e.g., water and the fluid is injected from the nozzle into the space and so on.

Considering the above-mentioned attempts individually, however, the present states of the art have been such that the desired effect is obtained by increasing the pressure of the injected fluid since these attempts are not easily applicable to objects having many irregularities, do not have much effect in reducing the decay and increase the size of the device. As a result, actually expensive devices employing a high-power high pressure generator, a high pressure resistant pipe member and a nozzle meeting severely defined requirements have inevitably resulted.

On the other hand, it has been known that when a high-pressure fluid jet is injected in another fluid, cavitation is caused by the injected fluid. Various studies have been made to prevent the cavitation since the cavitation causes errosion of the surrounding component parts. Devices utilizing the cavitation, e.g., emulsifying devices have been known in some fields. However, it has been true that the general tendency is toward avoiding the occurrence of cavitation. In this connection, the studies on the mechanism of occurrence of cavitation due to a fluid injected in another fluid has been analyzed by H. Rouse, etc., and it has been known that the cavitation is caused by a velocity variation and a pressure variation in a mixed region of an injected fluid and a surrounding fluid.

As regards the shape of nozzles, nozzles of a so-called convergent-divergent shape have already been used as nozzles for gases and nozzles of the similar shape have been used as nozzles for liquids in some fields for nozzle clogging prevention purposes.

SUMMARY OF THE INVENTION

In view of the foregoing background art, it is an object of the present invention to provide a nozzle device designed to positively promote the occurrence of cavitation due to the injection of fluid so that the crushing or eroding effect due to the cavitation is utilized fully and the decay in the energy of the injected fluid is reduced thereby greatly increasing the work done by the submerged fluid injection than previously.

To accomplish the above object, in accordance with the invention there is thus provided a nozzle device in which a nozzle includes an orifice section and a nozzle exit formed downstream of the orifice section and having a greater opening cross sectional area than the orifice section.

In accordance with a preferred embodiment of the invention, the rate of increase of cross sectional area of the nozzle exit over that of the orifice cross section is such that the nozzle exit has a gradually increased longitudinal-sectional shape with an angle of 20 to 60 degrees with respect to the axial center of the orifice section at least near the exit portion of the orifice section. Preferably, the length of the nozzle exit is selected 4 to 20 times the diameter of the orifice section.

In accordance with one embodiment of the invention, the orifice cross section is circular in section at least in the exit portion thereof.

In accordance with another embodiment of the invention, the orifice cross section is oval in section at least in the exit portion thereof.

In accordance with another embodiment of the invention, the orifice section is rectangular in cross section at least in the exit portion thereof.

In accordance with the invention, there is the effect of positively utilizing the crushing effect of cavitation due to the injection of a fluid jet under fluid, e.g., under water, and also reducing the decay in the energy of the injected fluid thus ensuring effective performance of cleaning, drilling, mixing, agitation, cutting, turning and other operations. Thus, the present invention is very effective from the standpoint of the effective energy utilization in that the energy of the injected fluid can be utilized effectively and that a great effect is obtained without hazardously increasing the pressure as is the case with the prior art. Also, due to the fact that the same effect can be produced with a low pressure as with a high pressure, there is the advantage of permitting the use of a low pressure-resistance pipe member and reducing the cost of assembling the peripheral device. Then, due to the simple construction of the nozzle according to the invention, there are very great effects that the nozzle can be provided at the same cost as the conventional nozzle and so on.

The above and other objects as well as advantageous features of the invention will become more clear from the following description taken in conjunction with the drawings.

DESCRIPTION OF THE PREFERRED EMBODIMENTS

The present invention will now be described in greater detail with reference to the illustrated embodiments.

Figure 1:
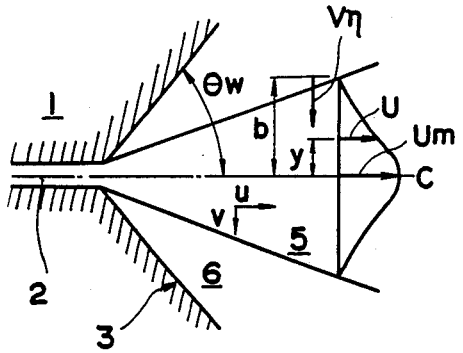
FIG. 1 is a diagram schematically showing the longitudinal section of a jet flow.
Figure 2:
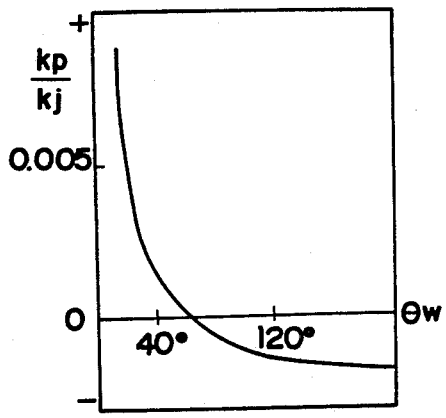
FIG. 2 is a diagram showing the relation between the energy of an injected fluid and the angle of a side wall.
Figure 3:
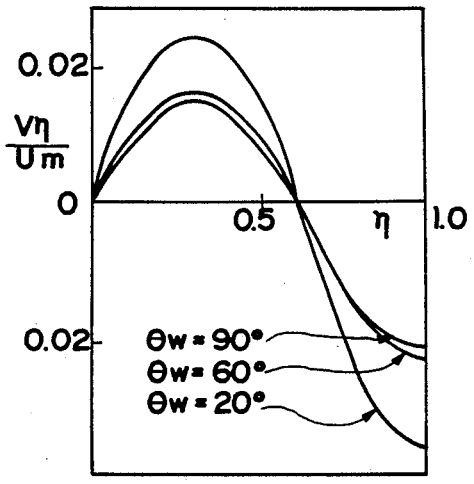
FIG. 3 is a diagram showing the relation between the side wall and the induced velocity.
Figure 4:
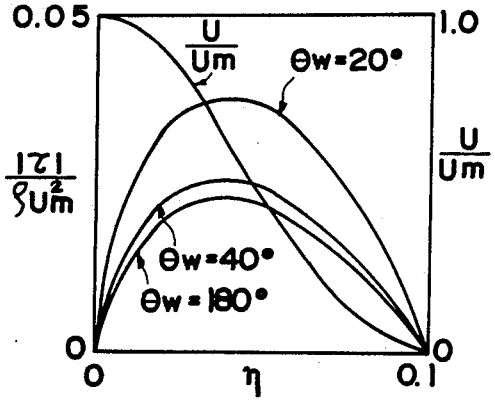
FIG. 4 is a diagram showing the variations of a shearing stress involved in cavitation.

FIG. 1 shows a model in which an ordinary turbulent jet is injected in a fluid from a nozzle having a side wall. In the Figure, numeral 1 designates a nozzle having an orifice section 2 and a side wall 3 provided downstream of the orifice section 2. Assuming now that kj represents the value of an energy of an injected fluid 5 and kp represents the value of an energy due to an induced velocity induced in a surrounding liquid 6 by the injected fluid 5, it has been confirmed that the relation between an angle $\theta w$ formed by the side wall 3 and the injected fluid 5 and the value of kp/kj becomes as shown in FIG. 2. In other words, it will be seen that while the injected fluid 5 loses its energy due to the entrainment of the surrounding fluid 6 in a region where the angle $\theta w$ is greater than 60°, where the angle $\theta w$ is below 60°, the energy loss is reduced and the entrainment phenomenon of the surrounding fluid 6 is made more manifest. Assume that in FIG. 1 b represents the radius of the injected fluid 5 at a given position on the axial center C of the injected fluid 5, U the flow velocity of the injected fluid 5 at the position of b, Vn the flow velocity in the direction of the axial center and y the distance from the axial center C at the point of the flow velocity U. Also assume that $\eta$ represents y/b. FIG. 3 shows the relation between these variables and the velocity Vn at which the injected fluid 5 is diffused in the radial direction. From the Figure it will be seen that the induced velocity is increased with a decrease in the angle $\theta w$ when $\eta=1$, that is, at the surface of the injected fluid 5 or at the boundary of the injected fluid 5 and the surrounding fluid 6. In relation to this, the velocity variation and pressure variation within the injected fluid 5 are increased considerably. This gives rise to a cavitation phenomenon. Considering the shearing stress $\tau$ of the injected fluid 5, there result the relations as shown in FIG. 4. In the Figure, $\rho$ represents the density of the injected fluid 5, Um the central velocity of the injected fluid 5 and U the axial flow velocity of the injected fluid 5. Thus, it is seen that the shearing stress $\tau$ is increased with a decrease in the angle $\theta w$ and the cavitation phenomenon is made particularly manifest in the mixed region of the injected fluid. However, it is also seen that where the angle $\theta w$ is below 20°, the cavitation phenomenon is suppressed due to the attachment phenomenon, friction, etc., between the injected fluid 5 and the side wall 3.

The above-mentioned preliminary experiments have shown that the injected fluid 5 loses its energy due to the entrainment of the surrounding fluid 6, that the limitation of the angle of the side wall 3 to a specified range has the effect of causing the injected fluid 5 to entrain the surrounding fluid 6 in a limited region and thereby increasing the shearing stress to make manifest a cavitation phenomenon, that the side wall 3 does not disturb the surrounding fluid 6 and hence protects the injected fluid 5 and so on.

Figure 5:
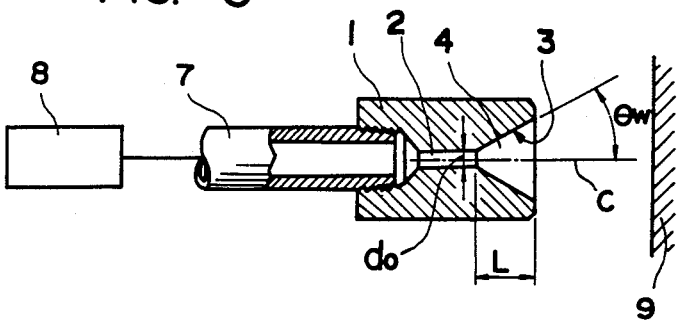
FIG. 5 shows an embodiment of the invention.

FIG. 5 shows an embodiment of a nozzle according to the invention in which a nozzle 1 is connected to a high pressure generator 8 through a pipe member 7. The nozzle 1 includes an orifice section 2 and a nozzle exit 4 provided downstream of the orifice section 2. Numeral 3 designates a side wall defining the nozzle exit 4. Designated by $\theta w$ is the angle made by an axial center C of the orifice section 2 and the side wall 3 defining the nozzle exit 4 or the half angle of exit nozzle 4.

In a range between 20 and 60 degrees, the angle $\theta w$ is effective in causing a cavitation phenomenon. Particularly, in a range between 20 and 40 degrees, the angle $\theta w$ shows a very remarkable cavitation generating condition. Thus, the angle $\theta w$ has the effect of reducing the decay in the energy of the injected fluid 5 and ensuring effective application of the jet energy to an object 9 to be jet processed.

Figure 6:
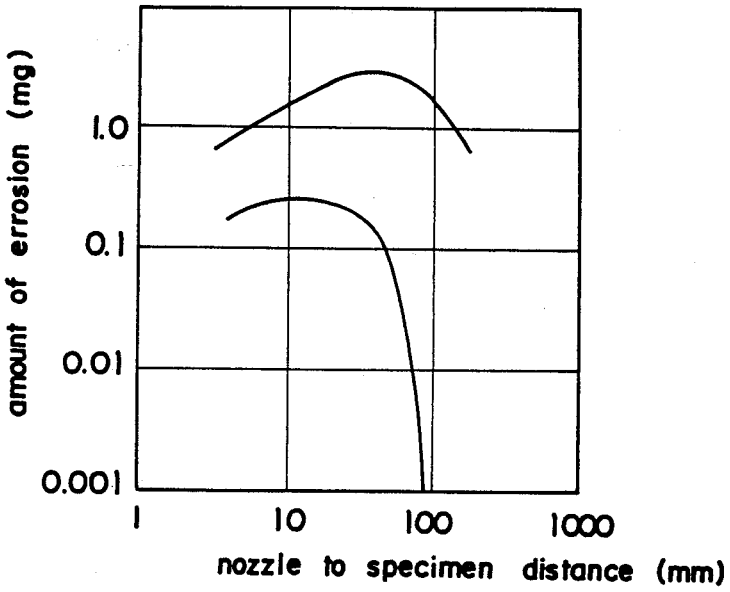
FIG. 6 is a diagram showing the difference in effect between the nozzle of this invention and the conventional nozzle.
Figure 7:
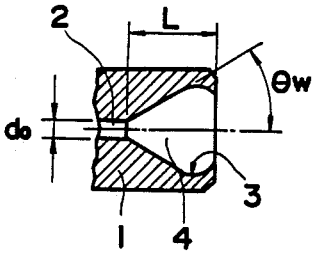
FIG. 7 shows another embodiment of the invention.
Figure 8:
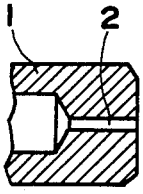
FIG. 8 shows a conventional nozzle of the ordinary type.

FIG. 6 shows the results of comparative experiments in terms of the amounts of errosion of the object 9 placed in a fluid.

Another important feature of the invention is the length of the nozzle exit 4. This length L is shown at L in FIG. 5. This length L has a close relation with the diameter of the orifice section 2 so that if the diameter of the orifice section 2 is designated by do as shown in FIG. 5, the length L in a range between 4 and 20 times, preferably from 5 to 12 times do can exhibit remarkable effects.

With the nozzle device constructed as described above, when the fluid is supplied to the nozzle 1 from the high pressure generator 8 through the pipe member 7, the fluid is converted to a high-velocity fluid flow and delivered to the nozzle exit 4. Due to the fact that the injected fluid 5 is protected by the side wall 3 defining the nozzle exit 4 and that the side wall 3 is formed to meet the previously mentioned requirements, the occurrence of cavitation is promoted thereby producing a crushing action and also the decay in the energy of the injected fluid is reduced thereby effectively applying the jet energy to the object 9 to be jet processed.

The present invention is applicable to all cases where generally use is made of a fluid injected at a high velocity in any other fluid and it can be used effectively in cleaning, drilling, mixing, agitation, cutting, turning and other operations.

What is claimed is:

1. A liquid jet injection nozzle for positive production of cavitation when submerged in a liquid, said nozzle consisting essentially of:

(a) an orifice section having a tubular bore of uniform cross-sectional area in communication with a pressurized liquid supply means producing a high velocity jet stream of liquid from said liquid supply means; and (b) a divergent nozzle exit section extending from the downstream end of said orifice section, said exit section having a length in the range of 5 to 12 times the diameter of the bore of the tubular orifice section and an inlet diameter equal to the diameter of said tubular bore and increasing in diameter along its axis at an angle with respect to the axis thereof in the range of 20 to 60 degrees.

2. A nozzle according to claim 1, wherein said orifice section is circular in section at least in the exit portion thereof.

3. A nozzle as defined in claim 1 wherein the angle of said divergent nozzle in said nozzle exit section is in the range of 20 to 40 degrees.

* * * * *